US006050680A

United States Patent [19]

Moriyama et al.

[11] Patent Number: 6,050,680

[45] **Date of Patent: *Apr. 18, 2000**

[54] INK JET RECORDING WITH MIXING AND STORAGE OF COLOR INKS WITH DIFFERENT MIXING RATIOS

[75] Inventors: Jiro Moriyama, Kawasaki; Shigeyasu Nagoshi, Yokohama; Hiroshi Tajika, Yokohama; Noribumi Koitabashi, Yokohama; Yuji Akiyama, Yokohama; Hitoshi Sugimoto, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/670,583

[22] Filed: Jun. 26, 1996

[30] Foreign Application Priority Data

Jun. 30, 1995 [JP] Japan ..... 7-166273

[51] Int. Cl.[7] ..... B41J 29/38; B41J 2/205; B41J 2/175

[52] U.S. Cl. ..... 347/85; 347/14; 347/15

[58] Field of Search ..... 347/43, 15, 84, 347/85, 7, 98, 100, 6, 14; 358/501

[56] References Cited

U.S. PATENT DOCUMENTS

| | | | |
|---|---|---|---|
| 4,494,128 | 1/1985 | Vaught | 347/15 |
| 4,614,953 | 9/1986 | Lapeyre | 347/43 |
| 4,635,078 | 1/1987 | Sakurada et al. | 347/15 |

FOREIGN PATENT DOCUMENTS

| | | | |
|---|---|---|---|
| 573274 | 12/1993 | European Pat. Off. | 347/7 |
| 3932-462 | 4/1991 | Germany | 347/43 |
| 59-115853 | 7/1984 | Japan | 347/43 |
| 61-173944 | 8/1986 | Japan | 347/43 |

*Primary Examiner*—N. Le
*Assistant Examiner*—Judy Nguyen
*Attorney, Agent, or Firm*—Fitzpatrick, Cella, Harper & Scinto

[57] ABSTRACT

The ink jet recording apparatus includes: first ink tanks that are replaceable and contain first inks containing colorants; a second ink tank that is replaceable and contains a second ink containing no colorant; third ink generating means to generate third inks by mixing the first inks and the second ink; and third ink tanks that contain the generated third inks with different mixing ratios and can supply the third inks to recording heads for selective ejection.

10 Claims, 7 Drawing Sheets

INK JET RECORDING WITH MIXING AND STORAGE OF COLOR INKS WITH DIFFERENT MIXING RATIOS

BACKGROUND OF THE INVENTION

1. Field of the Invention

The present invention relates to an ink jet recording apparatus, especially the one capable of recording images having a tone, and more specifically to an ink jet recording apparatus that can record images with a plurality of inks with different densities for each color.

This invention can be applied to all kinds of recording apparatuses that record on recordable media such as paper, cloth and OHP transparencies and also to printers, copying machines and facsimiles.

2. Description of the Prior Art

The ink jet recording apparatuses are being used on printers, copying machines and facsimiles because of their advantages including low noise, low running cost, ease of reducing the size of apparatus, and ease of introducing color printing.

Color recording by the ink jet recording apparatus generally uses three color inks, cyan (C), magenta (M) and yellow (Y), or four including an additional black (Bk) ink. Using these inks, red (R) for instance is produced by M+Y, green (G) by C+Y, and blue (B) by M+C.

For improved halftone recording, a plurality of inks with different densities are used for each color, with an appropriate ink with an optimum density selected for printing.

Arranging the ink tanks containing a plurality of color inks with different densities near recording heads in the recording apparatus and moving the ink tanks along with the recording heads has the following drawbacks:

1. It is necessary to increase the capacity of a motor as a means for moving them, resulting in an increase in the size of the recording apparatus and cost.

2. The fact that many kinds of inks are used means degraded ease of use since replacement and supplement for each color ink is required when refilling the empty tanks and increases the kind of ink merchandised to increase burden in the merchandise distribution channels from manufacturers to users.

Another type of the ink jet recording apparatus is available, in which sub-ink tanks, mounted on recording heads so that they move together, are made small in volume and are supplied required amounts of inks from separate main tanks of large volume.

This type of apparatus, though it eliminates the first problem, cannot overcome the second one. Especially when a particular main tank becomes empty, it must be replaced by user and, depending on the kind of images being recorded, may require frequent replacement.

SUMMARY OF THE INVENTION

This invention has been accomplished to solve the above-mentioned problems experienced with the prior art and its objective is to provide an ink jet recording apparatus which can generate a plurality of kinds of third inks with differing mixture ratios by mixing first and second inks appropriately according to an object to be recorded. It is another object of this invention to provide an ink jet recording apparatus which can easily supply additional amounts of plural kinds of another ink according to the condition of use so as to prevent one of the plurality of kinds of inks from running out, thereby ensuring efficient use of the inks.

To achieve the above objective, the ink jet recording apparatus that performs recording by ejecting inks, comprises: replaceable first ink tanks containing first inks containing colorants; a replaceable second ink tank containing a second ink containing no colorant; third ink generating means for generating third inks by mixing the first inks and the second ink; and third ink tanks individually containing the third inks with different mixture ratios generated by the third ink generating means, the third ink tanks being able to supply the third inks to recording heads for selective ejection.

With this invention, the third ink generating means generates the third inks by mixing the first inks and the second ink. The densities of the third inks thus generated are detected by density sensing means, and a controller selects according to the recording data the third inks for recording. This ensures optimum recording at all times irrespective of density variations in the ink mixtures.

As described above, the ink jet recording apparatus of this invention comprises: replaceable first ink tanks accommodating first inks containing colorants; a replaceable second ink tank accommodating a second ink containing no colorant; third ink generating means to generate third inks by mixing the first inks and the second ink; and third ink tanks individually accommodating the third inks with different mixture ratios generated by the third ink generating means, the third ink tanks being able to supply the third inks to recording heads for selective ejection. This configuration allows recording with any combination of colors and tones to be carried out freely according to requirements. Further, it is possible to make available minimum required amounts and kinds of ink as needed according to the condition of recording, thus permitting rational and efficient use and supply of ink.

Furthermore, by feeding back the densities of inks used to the controller during recording, it is possible to control the image density so that high quality recording can be made at all times regardless of some variations in ink density.

The above and other objects, effects, features and advantages of the present invention will become more apparent from the following description of embodiments thereof taken in conjunction with the accompanying drawings.

DESCRIPTION OF PREFERRED EMBODIMENTS

Now, preferred embodiments of this invention will be described in detail by referring to the accompanying drawings.

Figure 1:
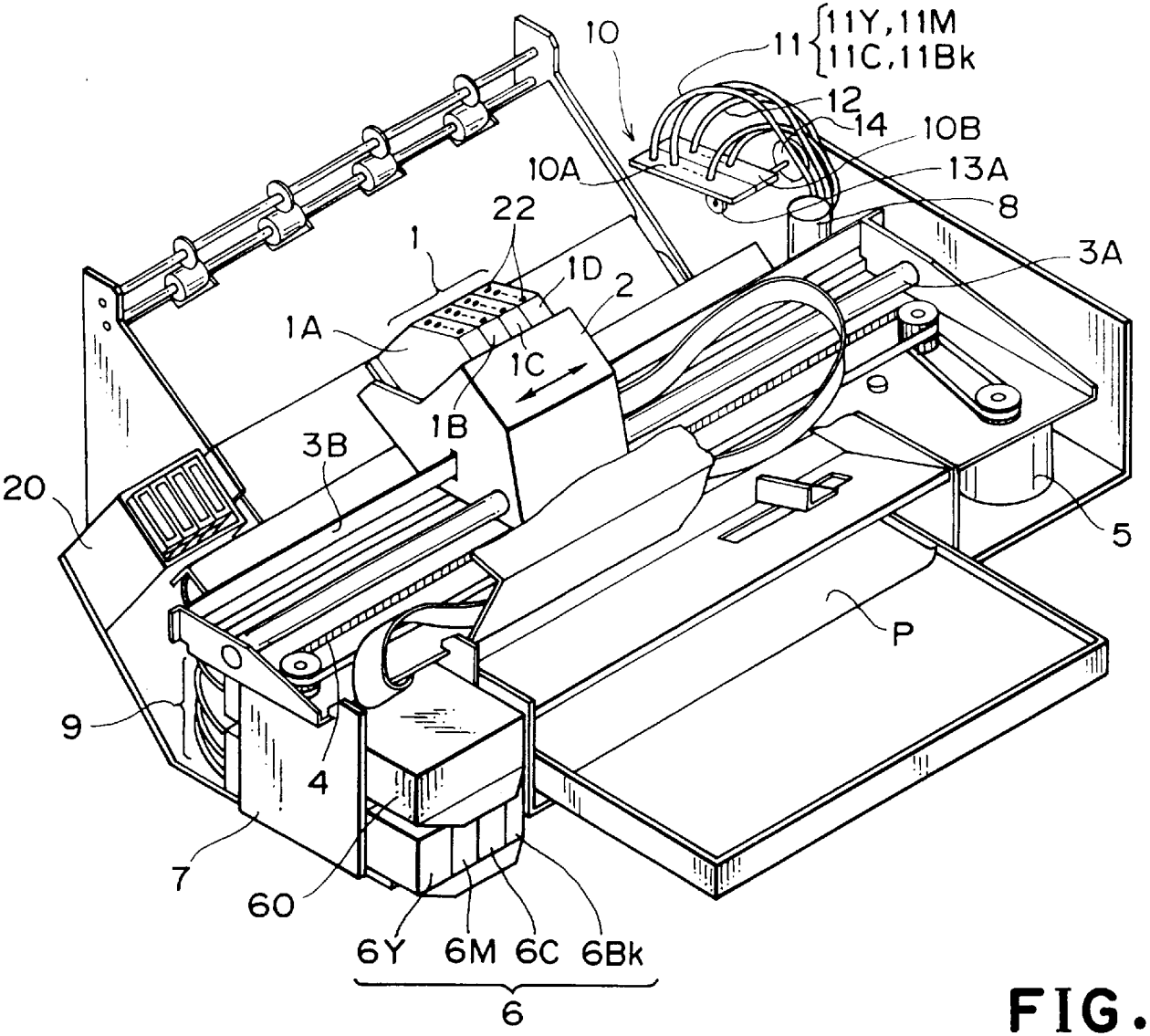
FIG. 1 is a perspective view showing an example configuration of the ink jet recording apparatus of this invention.

FIG. 1 shows one embodiment of this invention. Reference symbols 1A, 1B, 1C and 1D represent recording heads of this invention. Reference numeral 2 denotes a carriage that mounts these recording heads 1A–1D parallelly and travels along a guide shaft 3A and a guide rail 3B. Designated 4 is a timing belt that is connected to a carriage 2 and moves it at a predetermined timing. Denoted 5 is a carriage drive motor that drives the carriage 2 through the belt 4. The recording heads 1A–1D each have four sub-ink tanks containing inks of different colors and densities. The recording heads 1A–1D are made, for example, in the form of bubble jet type, in which four sub-ink tanks can individually eject ink droplets.

Reference numerals 6Y, 6M, 6C and 6Bk indicate main ink tanks (hereinafter referred to as first ink tanks) that contain inks having relatively high densities (referred to as first inks) with four color dyes or pigments (colorants)—yellow, magenta, cyan and black. Reference numeral 60 denotes a main ink tank (referred to as a second ink tank) containing a thinning ink (referred to as a second ink) including no colorant dyes and pigments to be mixed with the first inks contained in the first ink tanks 6Y–6Bk. These first ink tanks 6Y–6Bk and second ink tank 60 are secured to a casing 7 of the recording apparatus so that they can be removed and replaced.

Reference numeral 8 denotes a pump that delivers inks from the first ink tanks 6Y–6Bk and the second ink tank 60 to each of the sub-ink tanks of the recording heads 1A–1D respectively. The construction and operation of the pump 8 will bedetailed later. The pump 8 is connected to the first ink tanks 6Y–6Bk and the second ink tank 60 through ink supply tubes 9. Denoted 10 is an ink filling member made up of connecting plates 10A, 10B that support ink filling tubes coming from the pump 8. Designated 11 (11Y, 11M, 11C, 11Bk) are ink filling tubes provided between the pump 8 and the connecting plate 10A. Denoted 12 are other ink filling tubes provided between the pump 8 and the connecting plate 10B. The ink filling member 10 supplies inks into sub-ink tanks mounted at the top of the recording heads 1A–1D when the recording heads 1A–1D are moved by the carriage 2 to a position below the ink filling member 10.

Reference numeral 20 denotes a cap member for capping ink ejection orifice forming surfaces with a part of the member 20 hermetically contacting with ink ejection orifice forming surfaces so as to protect them during a standby state and an ink ejection recovery operation when the recording is not performed. During the ink ejection recovery operation, ink is drawn out of the ink ejection orifices through the cap member 20 by suction. When a recording sheet P as a recording medium is introduced by a feeding means not shown to a recording position, the recording heads 1A–1D are scanned and activated to eject inks of different colors with different densities onto the recording sheet P.

Figure 2:
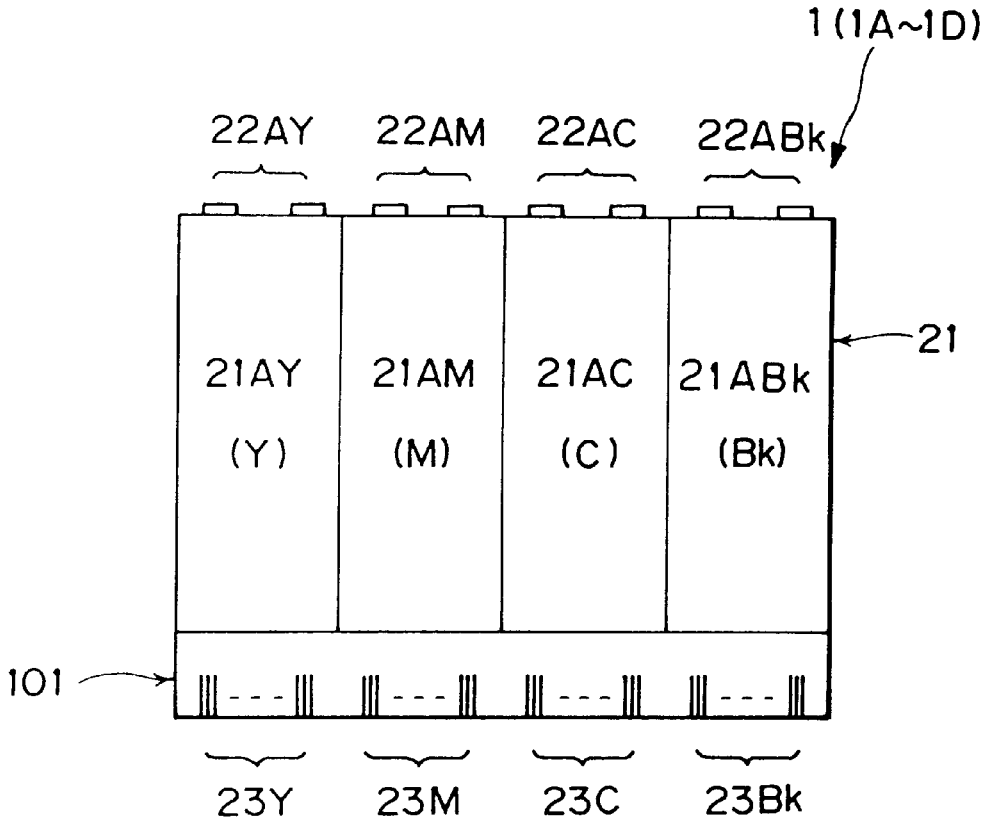
FIG. 2 is a schematic cross section showing the arrangement of sub-ink tanks mounted on one of recording heads of this invention.
Figure 3:
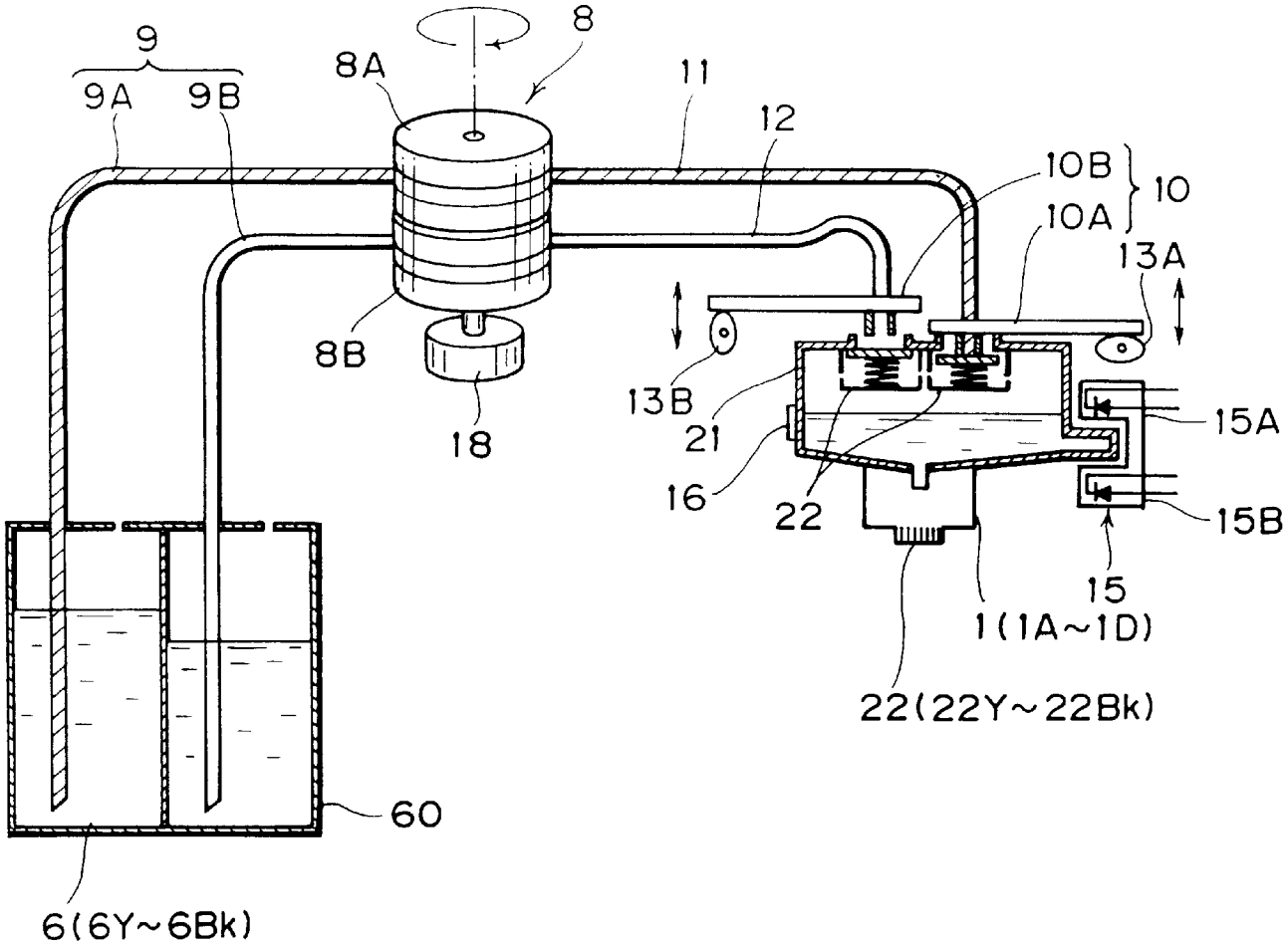
FIG. 3 is a schematically explanatory diagram showing the configuration and operation of an ink supply system for the sub-ink tanks.
Figure 4:
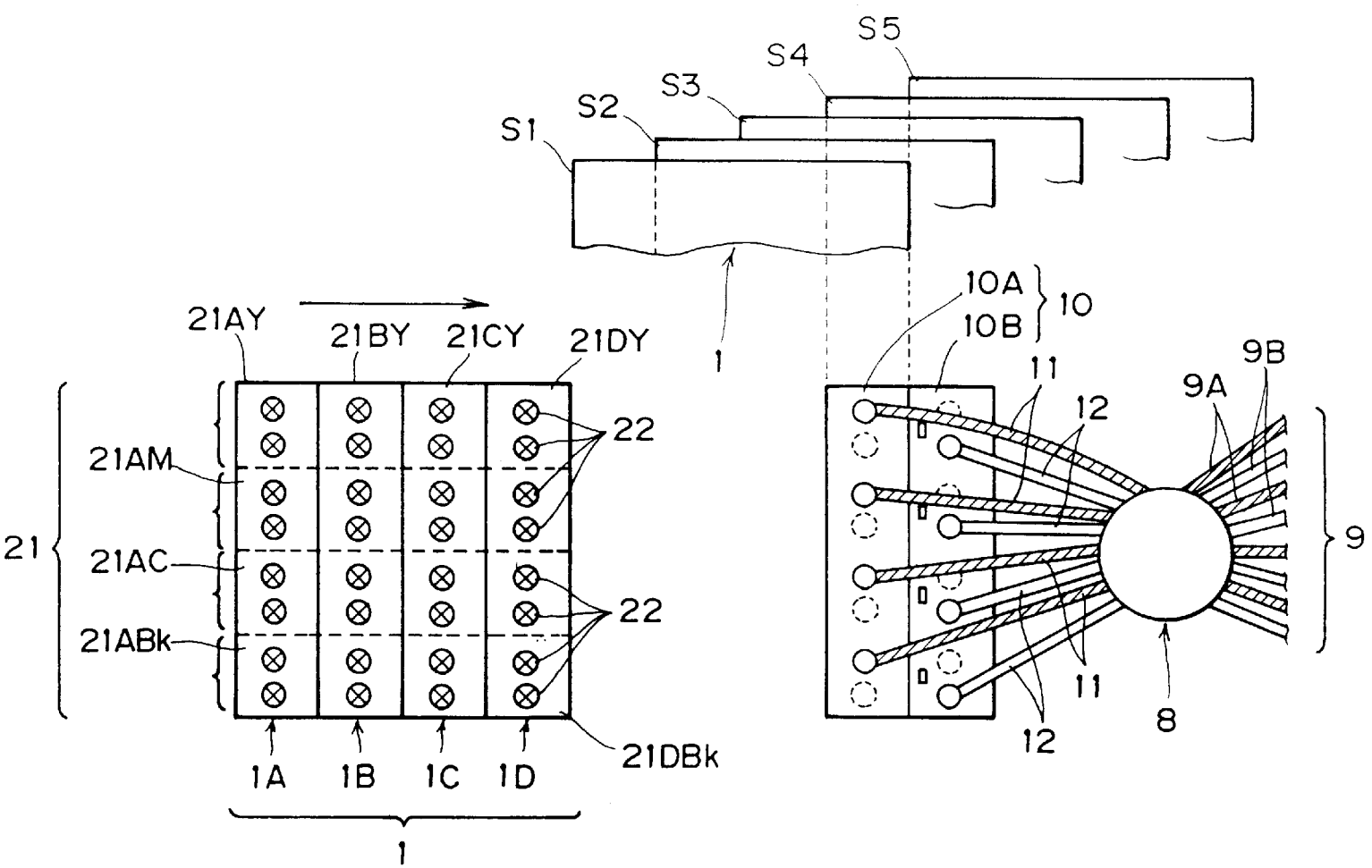
FIG. 4 is an explanatory diagram showing the operation of the ink supply system of this invention.

Next, let us explain how inks are delivered from the first ink tanks 6Y–6Bk and second ink tank 60 to the four sub-ink tanks provided to each of the recording heads 1A–1D by referring to FIGS. 2, 3 and 4.

FIG. 2 schematically shows one of the recording heads 1 (1A–1D), each of which is provided with four sub-ink tanks 21 divided in a direction perpendicular to the scan direction. In the case of the recording head 1A shown in the figure, for example, 21AY, 21AM, 21AC and 21ABk constitute the four sub-ink tanks. Denoted 22 (22AY, 22AM, 22AC and 22ABk) are paired in injection valves provided at the top of the sub-ink tanks 21 (21AY, 21AM, 21AC and 21ABk).

On the other hand, an ink ejection portion 101 of the recording head 1 has ejection orifice groups 23Y, 23M, 23C and 23Bk for respective inks, each consisting of 32 ejection orifices arranged linearly at a 360-dpi pitch, to eject inks supplied from each of the sub-ink tanks. The ejection orifice groups for different inks are spaced from each other a distance equal to 8 ejection orifices.

FIG. 3 shows diagram of ink supplying system and explanate the ink filling operation for sub-ink tanks 21AY–21ABk, 21BY–21BBk, 21CY–21CBk, 21DY–21DBk. The inks in the sub-ink tanks 21AY–21ABk are set to have a dye density of, for example, about 0.3%; and those in the sub-ink tanks 21BY–21BBk, 21Cy–21CBk and 21DY–21DBk are set at the dye density of approximately 0.6%, 1.0% and 3.5%, respectively.

Here the pump 8 is shown to be filling ink into one of the 16 sub-ink tanks 21.

To facilitate understanding, the figure only shows the connection between one of the first ink tanks 6Y–6Bk, the pump 8 and one of the sub-ink tanks 21 and also the connection between the second ink tank 60, the pump 8 and one of the sub-ink tanks 21.

As shown in this figure, the pump 8 of this example is a two-stage pump comprising a pump for the first ink (referred to as a first pump portion) 8A an a pump for second ink (referred to as a second pump portion) 8B. These pump portions 8A, 8B are driven by a single pump drive motor 18. Between the pump portions 8A, 8B and the pump drive motor 18 are arranged clutch mechanisms that can independently make selective coupling between the motor and the pump portions. The revolution per unit time and operation time of the pump drive motor 18 are controlled based on a drive control signal supplied.

The connecting plate 10A that forms the ink filling member 10, as shown in FIG. 4, is connected with four ink filling tubes 11 coming from the first pump portion 8A to supply the first inks of different colors from the first ink tanks 6Y–6Bk. The other connecting plate 10B is connected with four ink filling tubes 12 coming from the second pump portion 8B so that the second ink as the thinner ink can be supplied from the second ink tank 60. Although FIG. 4 shows four ink filling tubes 9B for introducing the second ink from the second ink tank 60 to the pump 8 (second pump portion 8B), only one ink filling tube 9B may be used depending on the configuration of the second pump portion 8B.

Returning again to FIG. 3, we will explain about the configuration as well as operation of the ink filling mechanism including the ink filling member 10.

First, as described in FIG. 2, each sub-ink tank 21 has two ink injection valves 22, which, when viewed from above, are arranged in matrix as shown in FIG. 4. These valves 22 are closed and opened by the up and down motion of the connecting plate 10A or 10B, as shown in FIG. 3. The connecting plates 10A, 10B are supported on the recording apparatus body so that they can be moved up and down. They are driven up or down as a first cam 13A and a second cam 13B rotate. The first cam 13A and the second cam 13B are rotatably supported on the recording apparatus body and are driven by a cam gear 14, as shown in FIG. 1.

In FIG. 3, denoted 15 is a density sensor of light transmission type that includes a light emitting element 15A and a light receiving element 15B and which is provided to each sub-ink tank 21. The sub-ink tank 21 filled with about 5 cc of inks from the first ink tank 6 and the second ink tank 60 is checked by the density sensor 15 for the ink density (third ink density). A vibrator 16 such as a piezoelectric element is used to make third inks (mixture of the first inks and the second ink) homogeneous. With this piezoelectric element, it is possible to mix the first ink and second ink supplied to each sub-ink tank 21 into a uniform mixture. The state of these inks during and after the mixing are monitored by the density sensor 15. When the sub-ink tank 21 is being filled, the piezoelectric element 16 is vibrated for a specified period, for example, about 10 seconds during which the drive control signal is supplied. Each sub-ink tank 21, after having been loaded with ink and subjected to the mixing operation, needs to maintain the internal pressure at a negative pressure of −3 to −6 cmaq slightly lower than the positive pressure in preparation for the recording operation. This negative pressure can be produced by reversing the pump 8 after ink filling. That is, when, before the recording operation, the connecting plates 10A, 10B are lowered to open the valves 22, the pump 8 is driven to draw about 10–20% of air from the sub-ink tank 21 to keep the internal pressure negative.

Next, by referring to FIGS. 3 and 4, we will explain the process of making the third inks by mixing the first and second inks supplied into each sub-ink tank 21 according to this invention.

In FIG. 4, symbols S1–S5 represent relative positions, shown in sequence, of the recording heads 1 with respect to the connecting plates 10A, 10B as the recording heads 1 mounted on the carriage are fed under the ink filling mechanism and the first and second inks are supplied into the sub-ink tanks 21 from the first ink tanks 6 and the second ink tank 60 by the pump 8.

That is, when the recording heads 1 are at a position S1, color inks (first inks) are injected through the connecting plate 10A into the sub-ink tanks 21DY–21DBk for the recording head 1D. Then, at a position S2, the second ink is supplied into these sub-ink tanks 21DY–21DBk through the connecting plate 10B and at the same time the first inks are poured into the sub-ink tanks of the recording head 1C through the connecting plate 10A. In the successive positions S3 and S4 inks are injected into the sub-ink tanks of the recording heads 1C, 1B and 1A, after which at the final position S5 the second ink is injected into the sub-ink tanks of the recording head 1A. Now, the process of filling all the sub-ink tanks 21 is complete.

Figure 5:
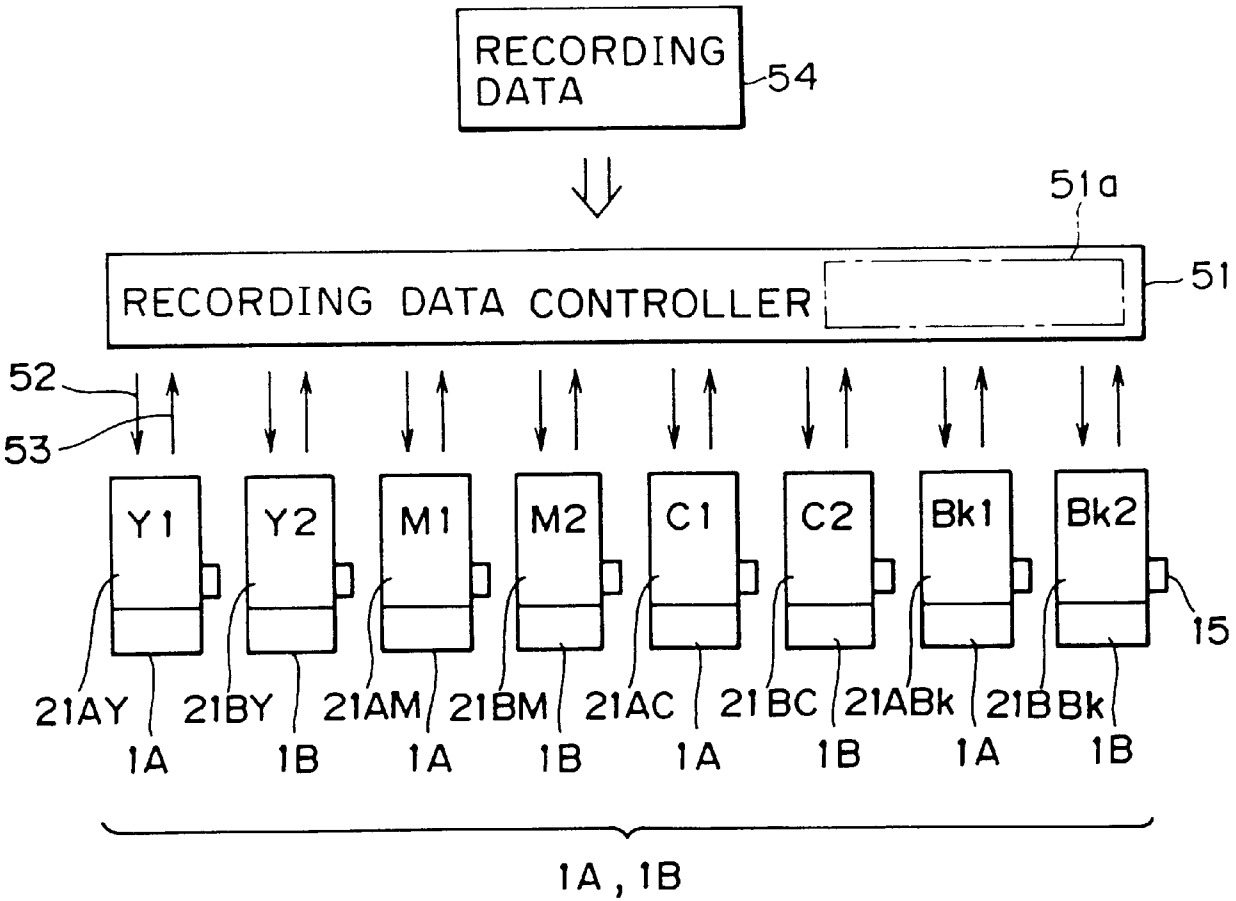
FIG. 5 is an explanatory diagram showing the flow of control signals generated by a recording data controller of this invention.

FIG. 5 shows the flow of signals between the recording heads 1 and a recording data controller 51. To simplify the explanation, let us consider a case where only two recording heads 1 are provided each having four sub-ink tanks corresponding to four colors Y, M, C, Bk and the inks filled into the sub-ink tanks are differentiated in density between the two heads, i.e., they are set at two different densities for each color. The recording data controller 51 has a storage section 51*a* to store for example the recording data for one A4-size recording medium and mapped ink dye density data described later. Signals from the density sensors 15 are sent as density data 53 to the recording data controller 51, which, based on these data and recording data 54, produces drive data 52 and selectively supplies them to the recording head 1A or 1B that corresponds to the required each density. In FIG. 5, reference symbols Y1, Y2, M1, M2, C1, C2, Bk1 and Bk2 represent two kinds of ink for each color having different densities.

In starting the recording operation, first, a A4-size recording sheet P is automatically fed and set in a recordable area. Then, the carriage 2 travels in the main scan direction to transport the recording heads 1 to a position under the connecting plates 10A, 10B, where, before the recording operation, a required amount of ink to print the recording data for one A4-size recording sheet P is supplied by the pump 8 from the first ink tanks 6 and the second ink tank 60 to the sub-ink tanks 21 that have different densities for each color. The recording apparatus supplies inks to the recording heads 1 in such a way that the sub-ink tanks 21 containing inks with higher densities will have greater ratios of the first inks. The amount of ink supplied to the sub-ink tanks 21 may also be set only large enough to record the recording data for one scan.

In this process, the recording data controller 51 based on the calculation using the recording data 54 for one recording sheet P, does not supply the drive data 52 on those inks that are apparently not required for recording. For example, when data on cyan (C) does not exist in the recording data 54, the recording apparatus does not supply inks to those sub-ink tanks 21 of the recording heads 1A–1D that are supposed to accommodate the cyan ink. Then, up to 16 kinds of ink supplied are checked by the sensors 15 for their densities. Using the detected density data 53, the recording data controller 51 determines, according to the recording data 54, the drive data 52 to be supplied to the recording heads 1 for each color and thereby causes the recording heads 1 to print as the carriage 2 performs the main scan. The recording apparatus repeats the main scan of the carriage 2 and the sheet feeding until the whole A4-size recording is completed.

Figure 6:
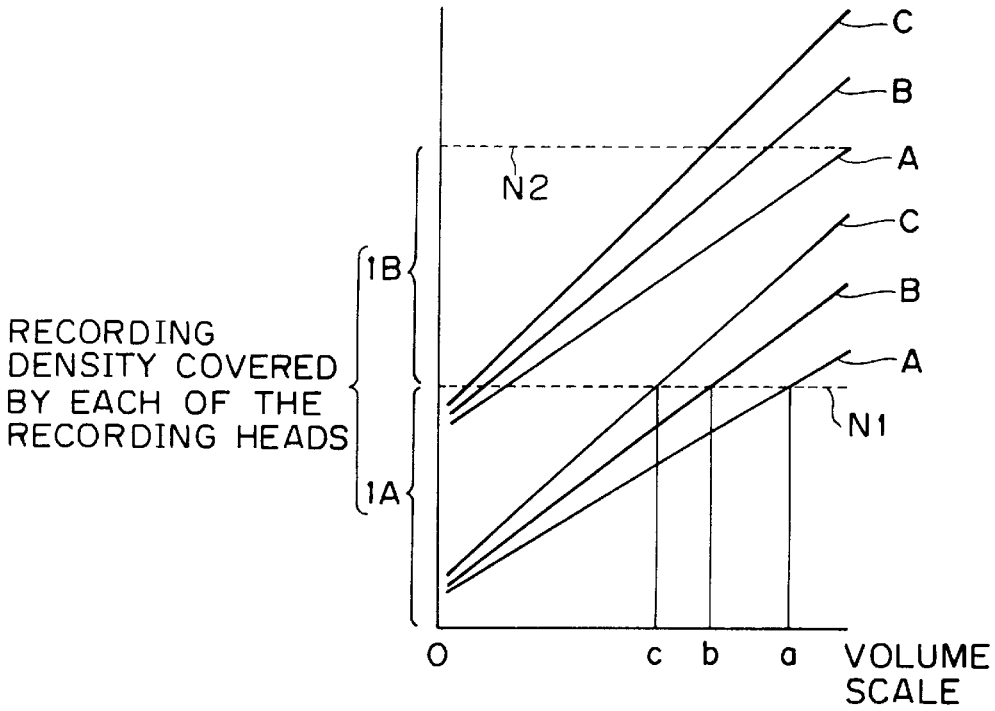
FIG. 6 is a characteristic diagram showing the relation between the ink dye density and the setting stage for use of the associated dye density according to this invention.

When the recording data controller 51 generates the drive data 52, it references the dye density data shown in FIG. 6 by using the density data 53.

FIG. 6 shows the relation between the density range of an image produced by the inks ejected from the heads 1A, 1B onto the recording sheet P and the dye density of the inks contained in each of the sub-ink tanks 21.

Here again let us consider a case where recording is done with only two heads 1A and 1B in order to simplify the explanation.

In FIG. 6, the ordinate represents the densities used by the recording heads 1A and 1B during recording, i.e., the range of recording density, covered by each of the heads 1A and 1B, of an image produced on the recording sheet P. The abscissa represents an ink volume scale for selecting a recording density, i.e., the ink volume corresponding to an ink dye density of the sub-ink tanks 21 (the amount of ink absorbed per unit area in a specified recording area). The graph shows dye densities of inks of the same color contained in the sub-ink tanks 21 of the recording heads 1A and 1B.

Characteristic lines A1–C1 represent dye densities of an ink of one color contained in a sub-ink tank 21 of the recording head 1A. Characteristic lines A2–C2 represent dye densities of an ink in a sub-ink tank 21 of the recording head 1B for the same color as that used for lines A1–C1.

For example, the characteristic lines A1–C1 represent inks having densities of 0.24%, about 0.3% and 0.36% respectively, and the characteristic lines A2–C2 represent inks having densities of 0.48%, about 0.6% and 0.72% respectively.

The volume scale for selecting the recording density is set for each of the characteristic lines A1, B1, C1, A2, B2, C2. The volume scales for lines A1, B1, C1 and those for lines A2, B2, C2 are similar and thus explanation is given only about the volume scales for the lines A1, B1, C1. Sixty-four levels are set one the volume scale for each characteristic line, with the ink volume increasing with the level as it goes toward the right in FIG. 6. The line A1 is so set that a level "a" is the 64th level. A level "b" for the line B1 and a level "c" for the line C1 both represent the 64th level.

In FIG. 6, dashed lines N1 and N2 that connect intersecting points between the vertical lines passing through the levels "a," "b," "c" and the characteristic lines A1, B1, C1 (characteristic lines A2, B2, C2) represent the maximum densities of the image recorded by the heads 1A and 1B.

Hence, in the characteristic lines A1, B1, C1 (characteristic lines A2, B2, C2), when the amount of inks adhering to unit areas in a particular region are equal, the gradient of the characteristic line increases as the dye density of ink becomes higher. And the greater the amount of ink adhering to the recording sheet, the higher the density of the recorded image obtained.

As a result, for the same density in the image recorded, the level "c" of an ink whose dye density is relatively high requires a smaller amount of the ink to be ejected onto the sheet than does the level "a" of an ink whose dye density is relatively low. Hence, in FIG. 6 the level "c" is set at a position to the left of the level "a."

In generating the drive data 52 for the recording head 1A, when the density data 53 indicates that the density in the sub-ink tank 21 has a certain value on the characteristic line A1, the recording data controller 51 selects the characteristic line A1 and sets one of the 64 levels according to the recording data 54. When the density data 53 shows that the density of the ink in the sub-ink tank 21 has a certain value on the characteristic line C1, the recording data controller 51 selects the characteristic line C1 and sets one of the 64 levels according to the recording data 54. Based on the level thus set and the recording data 54, the drive data 52 is generated.

Therefore, even if the dye density of an ink that is supposed to be around 0.3% should be 0.24% or 0.36%, it is possible to produce an image of a desired density by the recording head 1A.

When four recording heads 1 are used as in the above embodiment and four different densities for each color are used, the processing similar to the one described above is performed for the heads 1C and 1D.

As described above, by measuring the dye density of an ink contained in each sub-ink tank 21 and setting an optimum level of ink volume corresponding to the desired density by feed-back control, it is possible to maintain the desired density at all times and perform recording with precision even when the actual density of the ink made by mixing somewhat deviates from the intended density.

The first inks used here have the following compositions:

| | | |
|---|---|---|
| Y | Dye-stuff | 4.0 wt % |
| | Glycerin | 8.0 wt % |
| | Thiodiglycol | 8.0 wt % |
| | Urea | 8.0 wt % |
| | Water | balance |
| M | Dye-stuff | 4.0 wt % |
| | Glycerin | 8.0 wt % |
| | Thiodiglycol | 8.0 wt % |
| | Urea | 8.0 wt % |
| | Water | balance |
| C | Dye-stuff | 4.8 wt % |
| | Glycerin | 8.0 wt % |
| | Thiodiglycol | 8.0 wt % |
| | Urea | 8.0 wt % |
| | Water | balance |
| Bk | Dye-stuff | 4.8 wt % |
| | Glycerin | 8.0 wt % |
| | Thiodiglycol | 8.0 wt % |
| | Urea | 8.0 wt % |
| | Water | balance |

The second ink has the following composition:

| | |
|---|---|
| Dye-stuff | 0.0 wt % |
| Glycerin | 8.0 wt % |
| Thiodiglycol | 8.0 wt % |
| Urea | 8.0 wt % |
| Water | balance |

In FIG. 6, in setting the characteristic lines A1, B1, C1, A2, B2, C2 that represent the dye densities, the range of ink density needs to be within specified limits because too low a dye density of an ink may result in a failure of a desired density to be achieved on a recorded image even when the amount of ink per unit area in a specified region is increased, or too high a dye density may result in a recorded image failing to be represented in a continuous tone. When, for example, the dye density of each of these characteristic lines A1, B1, C1, A2, B2, C2 is set within a shaded range in FIG. 7, the inventor of this application has found with experiments that the density on the recorded image is optimal.

Figure 7:
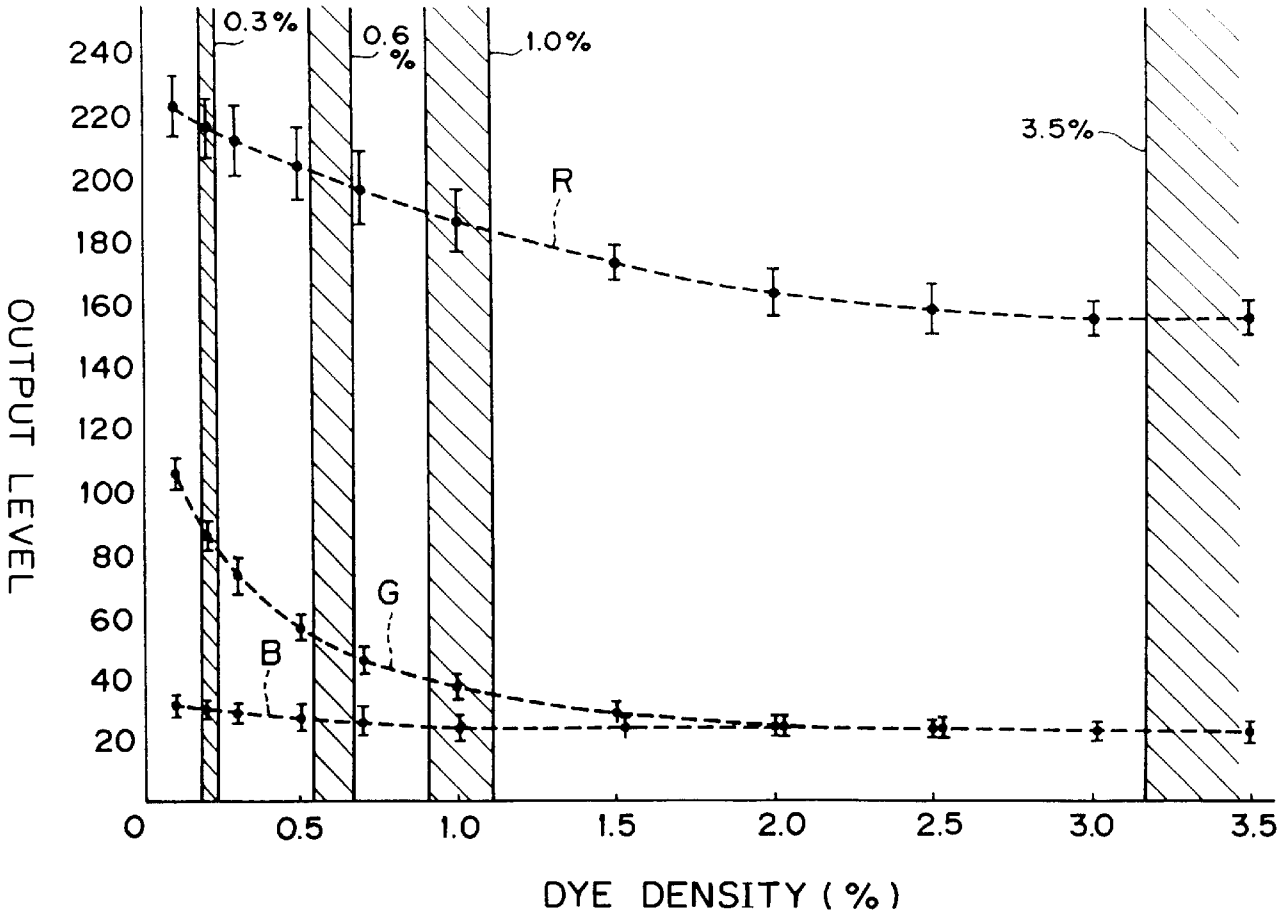
FIG. 7 is a characteristic diagram showing the relation between the dye density of ink and the measured output level according to this invention.

FIG. 7 shows an example of measured dye density levels (transmission densities) for an ink whose dye is a direct yellow 86. The thickness of an ink layer at the density sensor is 3.0 mm. The light receiving element 15B of the density sensor 15 used has an 8-bit resolution and can sense the density at 256 levels for each color signal (R, G, B) based on the transmitted light. The light emitting element 15A uses a white light source. Although there are errors in measurements, the final measurement precision can be improved by referencing data for each color signal (R, G, B) in the calculation process.

Shown here is a case where four dye densities of ink—0.3%, 0.6%, 1.0% and 3.5%—are used. When the results of measurements fall in the shaded areas, it is possible to produce an optimal density at all times according to an input signal by the feedback control of density measurement.

When the ink density should deviate from a target density range during mixing, the first or second ink may be added again to adjust the ink mixture to fall in a target density range. When, for example, the density of the ink mixture is lower than the target density range, only the first ink needs to be supplied again into the sub-ink tank 21. It is noted that the sub-ink tank is designed to have a slightly large capacity, considering the additional supply of ink. If an additional supply of ink fails to change the output of the sensor 15 from the one before the resupply, an indicator on the recording apparatus displays an error, temporarily shutting down the apparatus. In this case, the possible cause may be the first or second ink tank having run out of ink, or a pump system in trouble.

While in this embodiment a dye is used in the ink, it is possible to use a pigment or a combination of these.

A means to eject ink is not limited to an electrothermal converter and may use an electromechanical converter.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus that performs recording by ejecting inks using a recording head, the apparatus comprising:

first storage means for storing inks containing colorants;

second storage means for storing liquid which does not contain any colorants;

ink generating means for generating inks having different densities and belonging to the same color family as that of said ink stored in said first ink storage means, said ink generating means generating inks by respectively mixing the inks stored in said first storage means and the liquid containing no colorants stored in said second storage means;

detection means for detecting densities of inks generated by said ink generating means; and control means for controlling recording with the mixed inks through the recording head, wherein selective ejection of the mixed inks is carried out responsive to detected densities by said detection means in the mixed inks and responsive to recording data.

2. An ink jet recording apparatus according to claim 1, wherein the colorants have cyan, magenta and yellow colors, or cyan, magenta, yellow and black colors.

3. An ink jet recording apparatus according to claim 1, wherein the recording head for ejecting the inks has an electrothermal transducer or electromechanical transducer for generating energy to eject the inks.

4. An ink jet recording apparatus according to claim 1, wherein the first storage means has a plurality of chambers containing respective ones of different colored inks.

5. An ink jet recording apparatus according to claim 1, further comprising a plurality of third storage means for individually storing the mixed inks in different mixture ratios of different colorants generated by the ink generating means, the stored mixed inks capable of being supplied to the recording head for selective ejection.

6. An ink jet recording apparatus according to claim 5, wherein said plurality of third ink storage means individually supply the mixed inks with different mixture ratios to the recording head, the recording head having orifices corresponding to a respective color of mixed ink, and the recording head ejecting the mixed inks in different mixture ratios.

7. An ink jet recording apparatus according to claim 5, wherein said ink generating means distributes mixed inks in different mixture ratios of different colorants to respective ones of said plurality of third storage means.

8. An ink jet recording apparatus according to claim 5, wherein said first storage means comprises chambers respectively corresponding to the different colorants.

9. An ink jet recording method for recording by ejecting inks from an ink jet recording head, said method comprising the steps of:

generating a plurality of inks having different densities and belonging to the same color family as that of an ink stored in a storage means for storing inks containing colorants, said generating step generating the plurality of inks by mixing colored inks containing colorants and a liquid which does not contain any colorants;

detecting densities of colorants contained in the generated plurality of inks; and controlling recording of input data by controlled ejection of at least one of said generated plurality of inks through the ink jet recording head, said controlling step controlling according to the detected densities and according to the input data.

10. An ink jet recording method according to claim 9, further comprising the step of individually storing the mixed inks in different mixture ratios of different colorants, the mixed inks capable of being supplied to the ink jet recording head for selective ejection.

* * * * *

UNITED STATES PATENT AND TRADEMARK OFFICE

CERTIFICATE OF CORRECTION

PATENT NO. : 6,050,680
DATED : April 18, 2000
INVENTOR(S) : Moriyama, et al.

It is certified that error appears in the above-identified patent and that said Letters Patent is hereby corrected as shown below:

Title page,
Item [56], References Cited, U.S Patent Documents, insert:

| | | | |
|---|---|---|---|
| -- 4,337,468 | 6/1982 | Mizuno | 347/7 |
| 4,109,282 | 8/1978 | Robertson et al. | 347/98 |
| 3,476,874 | 11/1969 | Loughron | 347/100 -- |

Item [56], Foreign Patent Documents, insert:
-- 4-338554 11/1992 Japan 347/43 --; and
"3932-462" should read -- 3932462 --.

Column 3,
Line 30, "bedetailed" should read -- be detailed --; and
Line 65, "in" should read -- ink --.

Column 4,
Line 7, "explanate" should read -- explains --; and
Line 23, "an" should read -- and --.

Column 5,
Line 62, "a" should read -- an --.

Column 6,
Line 63, "one" should read -- on --.

Signed and Sealed this

Second Day of October, 2001

*Attest:*

Nicholas P. Godici

NICHOLAS P. GODICI
*Acting Director of the United States Patent and Trademark Office*

*Attesting Officer*